US008095997B2

(12) United States Patent
Harris

(10) Patent No.: US 8,095,997 B2
(45) Date of Patent: Jan. 17, 2012

(54) MODULAR CARTRIDGE BASED LIQUID DISPENSER SYSTEM FOR TOILETS AND BIDETS

(76) Inventor: Robert Marion Harris, Roseville, CA (US)

( * ) Notice: Subject to any disclaimer, the term of this patent is extended or adjusted under 35 U.S.C. 154(b) by 973 days.

(21) Appl. No.: 12/036,238

(22) Filed: Feb. 23, 2008

(65) Prior Publication Data

US 2009/0211003 A1 Aug. 27, 2009

(51) Int. Cl.
*E03D 9/02* (2006.01)

(52) U.S. Cl. ..... 4/313; 4/225.1; 4/227.1

(58) Field of Classification Search ..... 4/313, 406, 4/DIG. 3, 223, 225.1, 227.1
See application file for complete search history.

(56) References Cited

U.S. PATENT DOCUMENTS

| | | | | | |
|---|---|---|---|---|---|
| 2,099,932 | A * | 11/1937 | Isaacson | 4/353 |
| 2,515,569 | A * | 7/1950 | Pozun | 4/225.1 |
| 2,520,056 | A * | 8/1950 | Pozun | 4/225.1 |
| 2,620,486 | A * | 12/1952 | Addlesburger | 4/227.1 |
| 3,314,080 | A * | 4/1967 | Shilling, Jr. | 4/353 |
| 3,803,579 | A * | 4/1974 | Compton | 340/309.7 |
| 3,890,657 | A * | 6/1975 | Gray | 4/225.1 |
| 3,999,226 | A * | 12/1976 | Wolf | 4/225.1 |
| 4,174,589 | A * | 11/1979 | Daharsh | 47/66.6 |
| 4,262,372 | A * | 4/1981 | Ryder | 4/222 |
| 4,307,923 | A * | 12/1981 | Raz | 312/237 |
| 4,371,993 | A * | 2/1983 | Patrick | 4/448 |
| 4,392,260 | A * | 7/1983 | Bensen | 4/324 |
| 5,036,553 | A * | 8/1991 | Sanderson | 4/313 |
| 5,073,992 | A * | 12/1991 | Herring et al. | 4/227.1 |
| 5,313,674 | A * | 5/1994 | Chiang et al. | 4/406 |
| 5,519,900 | A * | 5/1996 | Gardner | 4/353 |
| 5,673,439 | A * | 10/1997 | Kuo | 4/222 |
| 5,881,396 | A * | 3/1999 | Rivera | 4/225.1 |
| 6,076,199 | A * | 6/2000 | Na | 4/420.4 |
| 6,496,987 | B1 * | 12/2002 | Chou | 4/227.2 |
| 6,662,379 | B2 * | 12/2003 | Nguyen et al. | 4/225.1 |
| 6,944,890 | B1 * | 9/2005 | Sim | 4/225.1 |
| 6,993,795 | B2 * | 2/2006 | Prineppi | 4/227.1 |
| 7,028,347 | B2 * | 4/2006 | Sanderson | 4/313 |
| 7,322,054 | B2 * | 1/2008 | Bush | 4/406 |
| 7,543,339 | B1 * | 6/2009 | Harris | 4/445 |
| 2007/0028376 | A1 * | 2/2007 | Chu | 4/353 |
| 2007/0151005 | A1 * | 7/2007 | Wilson et al. | 4/227.1 |

* cited by examiner

*Primary Examiner* — David Purol

(57) ABSTRACT

A modular cartridge based liquid dispensing system for automatically dispensing a metered amount of liquid(s) into a toilet water tank and/or bowl. This unique programmable system mounts onto a standard water tank, and is shaped to match the tank so that it blends well with the existing toilet design for aesthetics. It is designed to dispense one or a plurality of solution types, allowing any desired solution to be dispensed, such as cleaning solutions and deodorants. It uses replaceable liquid cartridges that can be refillable or disposable, and can also use fixed tanks. This invention can also utilize all of its components in a low-rise cabinet chassis that allows the entire system to be mounted inside the water tank where it is completely hidden from view. The system also has provisions for an optional automatic toilet flushing device and can also be used to dispense its liquids to a bidet apparatus.

20 Claims, 12 Drawing Sheets

MODULAR CARTRIDGE BASED LIQUID DISPENSER SYSTEM FOR TOILETS AND BIDETS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Filed of the Invention

The present invention relates in general to a programmable cartridge based device for automatically dispensing a metered amount of liquid or liquids into a toilet's water tank and features an optional flush control system. This device is also designed to be used to dispense liquids to a bidet device under development by the present inventor.

2. Description of the Prior Art

Toilet bowl sanitation has been a problem since the invention of the flush toilet. Toilets may contain microscopic organisms that can thrive and propagate to contaminate the toilet and bathroom. These germs can leave smelly, hard to clean deposits in the toilet bowl.

Early attempts at toilet sanitation relied upon manual methods of cleaning. It is a laborious chore, requiring frequent cleaning sessions and an expenditure of a substantial amount of time and labor. This gave rise to the advent of the automatic toilet bowl cleaning device. Currently, there is many of such automatic toilet bowl cleaning devices on the market. However, these devices have proved to be lacking in many respects.

One common method is to utilize dry chemical, water-soluble tablets of cleaner. These dry tablets are generally are submerged in the toilet tank so that the tablets slowly dissolve in the tank water, releasing a cleaning or disinfectant agent. The cleaning agent is then released into the toilet bowl when the toilet is flushed. The basic problem with these devices is that there is no control over the rate of chemical discharge. The dry chemical tablet will disintegrate and dissolve away relatively quickly at a set rate, which can result in far more of the product being consumed than needed for each flush cycle. Accordingly, it is necessary to replace the cleaning agent tablet frequently, resulting in an increased effort to keep the toilet clean. This is both costly and wasteful.

Another common method of toilet bowl sanitation utilizes a housing arrangement for a dry chemical tablet of cleaner. The housing partially isolates the tablet from the water supply to help slow the disintegration of the dry chemical in order to promote a more consistent delivery of the chemical treatment into the water for each flush. However, these passive devices still rely on a fixed dissolution rate. This results in an inconsistent delivery of the chemical for each flush.

A third method of toilet bowl sanitation utilizes a liquid chemical dispenser. These dispensers allow for a predetermined amount of the chemical solution to be injected into the water tank after each flush. However, many of these devices are bulky and can detract from the toilet aesthetics. They also have limited or no adjustments to allow a user to select a desired concentration level.

A toilet sanitation device suitable for retrofit installation to existing toilet fixtures, or original installation into manufactured fixtures that is easily installed, inexpensive and does not detract from the aesthesis of the bathroom would be highly desirable. It would also be desirable to have a device that can automatically dispense a programmed amount of a liquid into the water tank after each flush. It would also be desirable to have more than one dispensed type of solution.

Therefore, it can be appreciated that there exists a continuing need for a new and improved toilet sanitization devices for a toilet. In this regard, the present invention substantially fulfills this need.

OBJECTS AND ADVANTAGES

It is an object of the present invention to provide an improved toilet dispensing device wherein the rate of dispersal of the water treatment solution is positively controlled in comparison to prior art devices, which in turn results in the working life of the water treatment solution being significantly extended.

It is a further object of this invention to provide a liquid dispenser for automatically dispensing a metered and reproducible volume of disinfecting and deodorizing cleaner into the water tank of a toilet in response to the normal flushing action of the toilet It is a further object of the present invention to provide an improved dispensing device wherein use is made of a removable cartridge containing the water treatment material, whereby, upon the material being fully consumed, a user need only insert a replacement cartridge, without having to remove the device in its entirety.

It is a further object of the present invention is to provide the ability to easily add disinfecting solution without the need to remove the toilet tank lid.

It is a further object of the present invention is to provide the ability for the device to dispense more than one type of solution.

It is a further object of the present invention to provide a liquid dispensing device that can also be used to dispense solutions to a bidet apparatus.

It is a further object of the present invention is to provide a product that has universal appeal to a wide variety of bathroom settings to provide the most inconspicuous and unobtrusive product as to maintain look the traditional bathroom.

It is a further object of the present invention to provide a toilet liquid dispensing device which is of extremely simple design and of low cost.

It is a further object of the present invention to provide a liquid dispensing device that has the ability to provide an indication of residual fluid level without the need to remove the tank lid.

It is a further object of the present invention is to provide a toilet sanitation device that can be readily fitted to and removed from an existing toilet tank system and that requires no bathroom alterations or special tools to install it.

SUMMARY OF THE INVENTION

In the view of the foregoing disadvantages inherent in the known types of toilet devices and accessories now present in the prior art, the present invention provides an improved sanitation device attachment for a toilet. As such, the general purpose of the present invention, which will be described subsequently in greater detail, is to provide a new and improved sanitation attachment for a toilet that has all the advantages of the prior art and none of the disadvantages.

The present invention accomplishes the above-stated objectives, as well as others, as may be determined by a fair reading and interpretation of the entire specification.

The present invention is a modular, programmable liquid dispenser that is designed to dispense a metered amount of a liquid solution into the toilet bowl after each flush. Therefore, a precise, consistent amount of solution is automatically dispensed to the water tank or directly into the toilet bowl during the toilet bowl refill. Consequently, the amount of chemical needed to clean/disinfect the toilet bowl is reduced. This also spares the user the burden of frequently having to add more cleansing solution to the toilet tank. The present invention consists of a modular cabinet housing, an electronic user programmable controller, a liquid cartridge, a liquid pump, a flush sensing device and an optional mechanism to automatically flush the toilet.

Modular Cabinet:

The present invention uses a unique modular cabinet that is designed to mount onto the top rim of a standard toilet water tank, that is inserted between the water tank and the water tank's lid. It is shaped to blend in with the design of the water tank for aesthetics. The bottom of the cabinet has guides that allow the cabinet to securely fit onto the rim of a water tank without the use of fasteners. The top edge of the cabinet housing has a rim shaped just like that of the water tank to allow the original toilet's lid to be re-installed, if desired. This allows the stock lid to be reused so that the general stock design of the toilet can be maintained and to help the cabinet to blend into the existing bathroom décor. The cabinet can have its own custom or integrated top as well. The modular design of this unit allows other modular cabinet assemblies to be installed above or below it.

User Programmable Electronic Controller:

To effectively cleanse, disinfect and deodorize toilet flushing water, usually only a small amount of water treatment material or additive is needed to be mixed with the flushing water. However, if the toilet is subjected to frequent use, then the toilet may require a more substantial concentration of solution in the bowl. Also, some cleansing solutions can be used full strength, whereas other cleansing solutions are so strong that they should always be diluted. Thus, it would be desirable for a user to vary the amount of sanitizer which is discharged into the tank and thus reach the bowl so that the preferred solution concentration can be achieved.

The present invention addresses this issue by utilizing a small, battery powered electronic controller. This programmable device controls a liquid pump to meter out a precise volume of liquid to be dispensed so that any desired level of solution concentration is possible in the toilet bowl. The controller receives an input from a sensor that has components attached to the toilet flush actuator lever. Once the sensor detects movement of the lever as the toilet if flushed, the controller then schedules a dispensing cycle. After a programmed amount of time has elapsed following the flush, the controller activates the liquid pump to dispense the solution.

The modular cabinet provides the space to mount the programmable controller. The controller is located on the front access panel of the cabinet to allow convenient access for programming. A cover plate protects and conceals the controller from view.

Liquid Cartridge System:

With many previous art devices, it can be inconvenient to replace the chemical dispenser or replenish the chemical solution. Some chemical dispensers are continuously immersed in the tank water resulting in a gross and slippery mold that may grow outside the dispenser. Moreover, it is impossible to check the residual amount of the chemical dispenser visually, without pulling off the tank lid. Some liquid dispensers can be very messy to refill. The present invention addresses these problems by making use of a unique removable liquid cartridge system. This feature allows a user several advantages and options, such as:

1) Convenient Access: The replaceable cartridge is inserted into a slot in the front of the modular cabinet, behind an access panel. This position allows the user easy reach to service the unit, without having to pull off the lid of the toilet tank
2) Convenient Packaging to Reduce Mess: The cartridge is a convenient, leak free container for liquids, allowing the user to handle it without coming in contact with the liquid inside, which could be a harsh, extremely concentrated chemical. The cartridge contains a small, spring-loaded liquid valve that is normally closed to prevent any leakage while the cartridge is removed from the cabinet. The liquid valve automatically opens when the cartridge is simply inserted into the cabinet.
3) Economical Use of Chemicals: A reusable and refillable cartridge options allows a user the ability to purchase sanitation solution in large quantities, such as economical gallon sized jugs. The cartridge can be simply removed from the cabinet, its cap removed and then refilled with solution.
4) User Choice of Chemicals: A refillable cartridge provides a user the ability to utilize any desired kind of readily available solution that could adequately sanitize the toilet, such as chlorine. Users that have swimming pools or hot tubs would likely have an ample supply of this, which saves the cost of special solutions.
5) Convenience of Service: An optional disposable cartridge allows the user the convenience of simply discarding a spent cartridge. This relieves the user from the task of refilling the cartridge and from the potential of making a mess. A user has only to flip down a convenient access door on the front panel of the cabinet, pull out and discard a spent cartridge and then simply insert a fresh cartridge into the device.
6) Solution Level Indication: A cartridge made of a transparent or semitransparent material would allow a user to visually see the fluid level inside the cartridge simply by glancing at it, thereby allowing the user to know how much fluid remains in the cartridge. An optional electronic fluid level detector could also be used sense the level of the liquid inside the cartridge and then provide feedback for the user, whereby the controller could flash a lamp and/or signal a beeper to occasionally chirp to indicate a low fluid level condition.

Multiple Liquid Cartridge System:

Many homes suffer from high concentrations of dissolved minerals in the water supply that can build up in the toilet bowl over time. These mineral deposits are not only unsightly, but can be a chore to clean. These deposits also provide an environment that allows bacteria to thrive, which can produce odors. Therefore, it would be desirable to have a device to automatically dispense a second solution into the toilet that can dissolve these mineral deposits.

The present invention addresses this issue by providing the ability for the device to dispense more than one kind of solution. This feature would fulfill the need for a user to select a second or third type of chemical solution to be dispensed into the toilet, such as a special chemical compound that can help dissolve mineral deposits before they have time to form.

The present invention thus allows for multiple cartridges to be utilized. A dual-cartridge unit would allow one cartridge to contain a basic cleaning and sanitizing solution while the second cartridge can contain a solution to dissolve mineral deposits. A third cartridge could contain a deodorant.

The current invention utilizes a single electronic controller that is designed to allow each cartridge to be independently programmed and controlled. Each fluid can be separately programmed for the amount of liquid to be dispensed as well as the frequency. While the sanitizing solution can be dispensed after each flush, the mineral dissolving solution can be added to the tank less frequently, such as once a week. Moreover, as this second fluid may be needed to be administered directly to the toilet bowl in its full strength, the current invention allows this possibility by its use of a flexible liquid discharge tube that can be inserted into the toilet's overflow pipe. Thus, the full concentrated liquid would then flow directly from the cartridge into the bowl.

Automatic Flush Control:

One common toilet problem is that microscopic organisms can thrive and propagate around the bowl of an unused toilet, where a regular bowl rinsing with a sanitizing solution is rarely performed. In time, an unused toilet can develop mold around the bowl. This may happen while a house is unoccupied for long periods, or if a particular toilet is seldom used.

Another common toilet problem is that of an unflushed toilet. An unflushed toilet is a very unwelcomed sight, which may be quite embarrassing for the person who left it that way as well as for the person who then discovers it. Nobody wants to forget this responsibility. Although this may be an infrequent event for adults, this "forgetting to flush" inaction is a very frequent event among children. This is not only unsightly, but the condition leaves the toilet in an unsanitary condition. This could result in more toilet stains and buildup, causing more frequent cleanups and extra work.

The current invention solves this problem by automatically flushing the toilet after use. Another feature of the modular cabinet is to provide the mounting structure for an automation device that can flush the toilet. The cabinet provides a dedicated place over the flush handle actuator lever to mount a solenoid or similar device that has the ability to mechanical lift the actuator lever, thereby flushing the toilet. The modular cabinet is also designed to accommodate a proximity sensor, which will detect that someone is using the toilet. Once the proximity sensor senses the toilet's occupancy and then detects a vacancy, the flush device will activate, which will pull up on the flush handle actuator lever thus flushing the toilet.

The electronic controller can be programmed to automatically perform a toilet flush at regular intervals as well, such as once a week, to keep the bowl sanitized. An automatic weekly flush would kill any bacteria that may be trying to form, thus keeping the toilet sanitized and prolonging the regular cleaning intervals.

Large Liquid Tank System:

One embodiment of the present invention is to accommodate the use of non-cartridge, tank style containers. A much larger tank would allow the ability of the device to hold a vast amount of liquid, which would provide a user the convenience of less frequent service refill intervals.

Low Profile Cabinet:

Yet another embodiment of the present invention is to utilize a low-profile cabinet for the liquid dispenser assembly to actually reside hidden from view inside the toilet water tank. A thin mounting rim or hanging strap is used to mount the cabinet assembly in place as protruding down into the water tank. This embodiment requires that the components be arranged for clearance of any components that exist inside the tank. The benefit of this embodiment is that the entire unit is completely hidden from view inside the tank. To service the dispenser, the tank lid is simply removed to gain access to the cartridge or tank.

Multipurpose Device for Bidet System Use:

A further embodiment of the present invention allows it serve as a multipurpose device, where it can be used in other ways, such as to dispense a solution or solutions to a bidet device. The present inventor has developed a special bidet device that utilizes the current invention as a means to deliver a cleansing liquid or liquids to a bidet sprayer.

Bathroom and Toilet Aesthetics:

One main object of the current invention is to provide the most inconspicuous and unobtrusive cabinet as to maintain look the traditional bathroom. The current invention achieves this because the toilet water tank mounted modular cabinet is shaped like the water tank so as to blend in with the existing facility, making it inconspicuous. The aesthetics of the toilet then appear normal, with the appearance of only a slightly taller than usual water tank. The modular cabinet could be provided with its own detachable lid, but reusing the original stock toilet lid will better preserve the original toilet aesthetics.

Universal Applications:

The component of this invention requiring the concern for universal application is the shape of the water tank mounted modular cabinet and its mounting guides. For universal applications, this modular cabinet could also be offered in a generic cabinet shape or "skin" that is designed to work on and look good with a wide range of brands and models, thus enhancing the ability to more widely use this product on existing toilets.

Ease of Installation:

The modular cabinet's position on the water tank also allows easy installation of the device as it merely sits on the water tank, using no fasteners. Guides on the cabinet's bottom mates with the water tank's rim to keep the cabinet securely in place. The top of the modular cabinet has a rim just like the water tank so that the original lid can be attached to it. This modular design allows it to be easily removed so that quick service to the components inside the water tank can be made, such as freeing up a stuck flush valve.

Conclusion:

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

The above mentioned objectives and advantages of this invention and the manner of attaining them will become more apparent and the invention itself will be best understood by reference to the following detailed descriptions of the invention taken in conjunction with the accompanying drawings.

BRIEF DESCRIPTION OF THE DRAWINGS

Various other objects, advantages, and features of the invention will become more readily apparent to those skilled in the art from the following detailed description when read in conjunction with the accompanying drawings, in which.

DRAWINGS—REFERENCE NUMERALS

Figure 1:
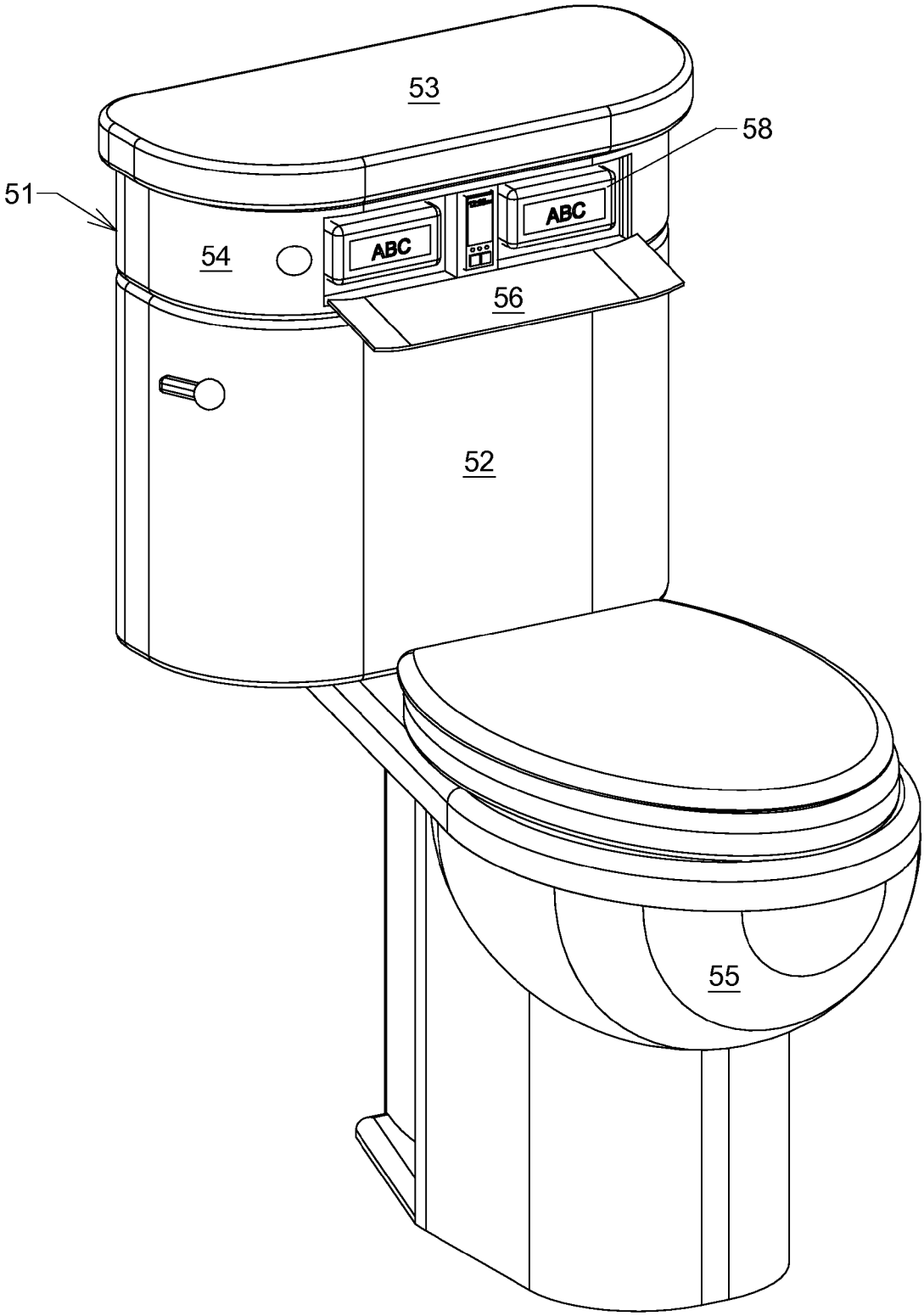
FIG. 1 is a front perspective view of a dual-cartridge version of the modular liquid dispenser as mounted on a standard toilet.

51 Assembly, Modular Liquid Dispenser Cabinet
52 Water Tank
53 Lid, Water Tank
54 Cabinet, Modular
55 Bowl, Toilet
56 Cover, Cartridge Access
57 Cartridge, Liquid Dispenser (Refillable)
58 Cartridge, Liquid Dispenser (Disposable)
59 Tube, Cartridge Drain
60 Cap, Vented Refill
61 Assembly, Liquid Pump
62 Fitting, Liquid Pump Inlet
63 Fitting, Liquid Pump Discharge
64 Tube, Flexible Liquid Discharge
65 Label, Cartridge
66 Battery
67 Cover, Battery Compartment
68 Rim
69 Guide, Cabinet Mounting
70 Slot, Liquid Discharge Tube Passageway
71 Module, Programmable Electronic Control
72 Orifice, Flush Linkage Passageway
73 Handle, Flush
74 Tank, Fixed Liquid Dispenser
75 Lever, Flush Actuator
76 Linkage, Flush Actuator Lever
77 Magnet, Flush Actuator Lever Linkage Attachment
78 Detector, Proximity
79 Assembly, Flush Sensor and Flush Actuator
80 Solution, Disinfecting/Deodorizing/Sanitizing
81 Assembly, Low-Profile Modular Liquid Dispenser
82 Chassis, Low-Profile Modular
83 Rail, Adjustable Flush Apparatus Mounting
84 Guide, Cartridge Alignment and Support
85 Valve, Pressure Relief
86 Pipe, Toilet Overflow
87 Clip, Adjustable Proximity Senor Mounting
88 Valve, Liquid Drain
89 Seal, O-Ring
90 Pin, Valve Actuator
91 Sensor, Liquid Level
92 Pane, Cartridge Liquid Level Window
93 Water
94 Clip, Metal Flush Lever

DETAILED DESCRIPTION OF THE DRAWINGS

Various other objects, advantages, and features of the invention will become more readily apparent to those skilled in the art from the following detailed description when read in conjunction with the accompanying drawings, in which like reference numerals designate like parts throughout the figures thereof.

FIG. 1 illustrates the basic idea of the present invention, where a dual-cartridge version of the modular liquid dispenser cabinet assembly 51 is shown mounted onto a standard toilet water tank 52. The modular cabinet 54 is shaped to match the shape of the water tank 52 so that it helps blend in with the toilet and décor of the bathroom. The stock water tank lid 53 can be installed onto the cabinet assembly 51 to help maintain the stock look of the toilet, or a custom tank lid can be used. The cabinet assembly 51 could also have an integral, non-removable top as well. An access cover 56, that normally conceals the cartridge compartment is shown open to illustrate the two cartridges 58 as docked into the modular cabinet 54.

Figure 2:
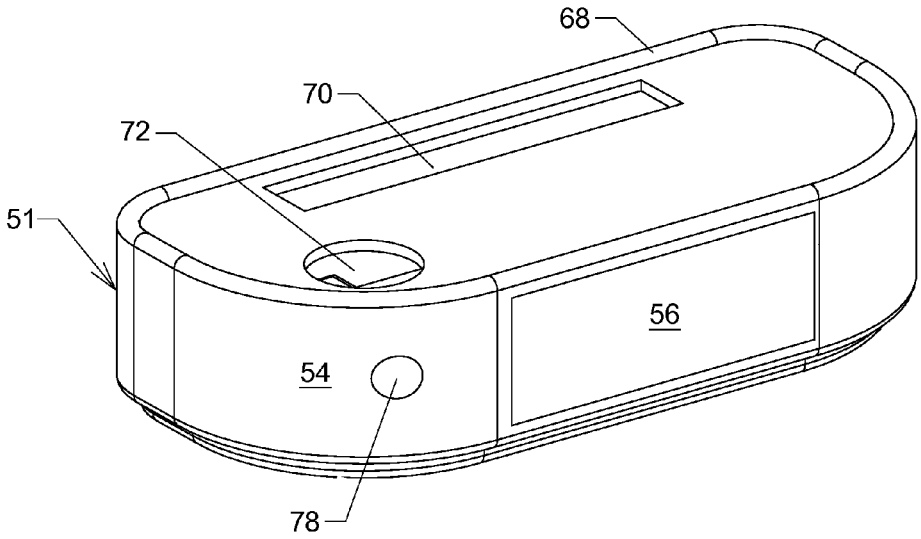
FIG. 2 is a top front perspective view of a single-cartridge version of the modular liquid dispenser with its cartridge access cover closed and reveals openings in the top as passageways through the cabinet so that other cabinets that may be mounted above it and can route its components through it to reach the water tank.

FIG. 2 shows a top front perspective view of a single-cartridge version of the modular liquid dispenser assembly 51 with its cartridge access cover 56 closed.

Figure 3:
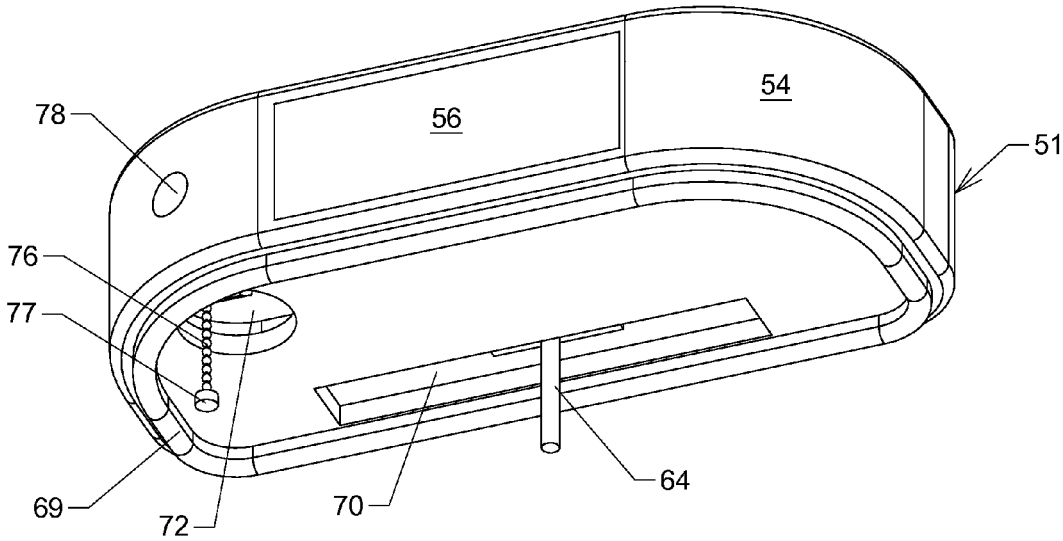
FIG. 3 is a lower front perspective view of a single-cartridge version of the modular liquid dispenser with its cartridge access cover closed and reveals openings for the liquid discharge tube and toilet flush actuator chain.
Figure 5:
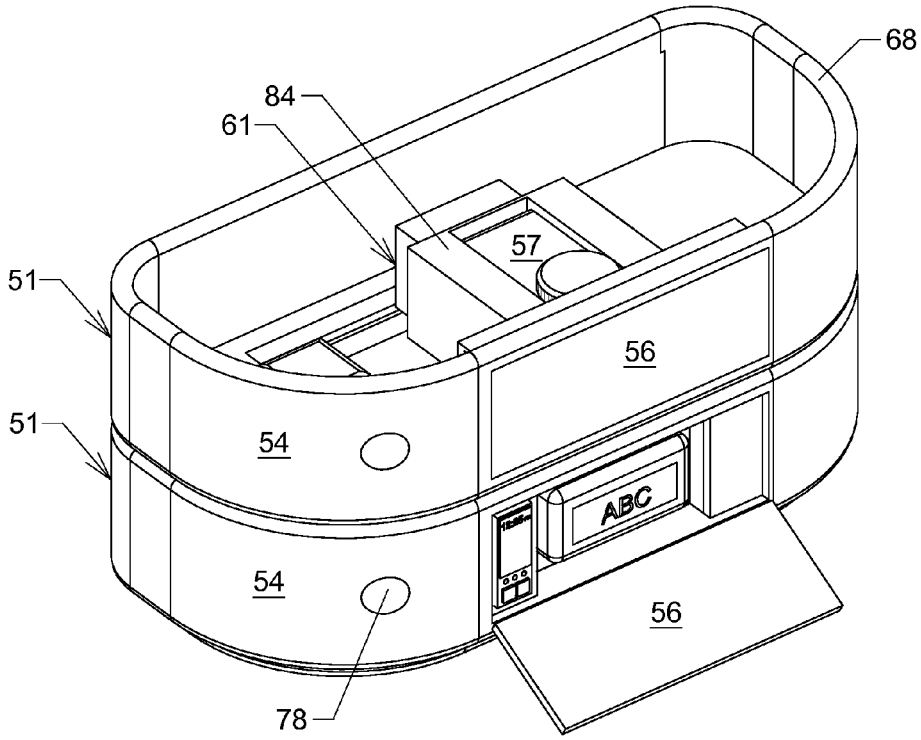
FIG. 5 is a top front perspective view of two single-cartridge versions of the modular liquid dispenser as stacked together to demonstrate the modular nature of the cabinets.

FIG. 2 and FIG. 3 shows a liquid discharge tube passageway slot 70 located on the top and bottom of the modular cabinet 54 to allow a passageway completely through the cabinet 54. Two stacked cabinets 54, as shown in FIG. 5, would need this passageway to route the discharge tube 64 from the top unit through the bottom cabinet 54 and on into the water tank 52 below it. Likewise, a flush linkage passageway orifice 72 provides a passageway through the cabinet 54 to allow the, flush actuator lever linkage 76 of a top mounted cabinet 54 to route through a lower cabinet 54 to reach the tank 52.

FIG. 3 shows a liquid discharge tube passageway slot 70 located at the back bottom side of the modular cabinet 54 that allows a passage space for the liquid discharge tube 64 so that it can extend down into the toilet water tank 52 to pass the liquid from the cabinet assembly 51 to the tank 52. FIG. 3 is also shows the mounting guides 69 that securely hold the cabinet assembly 51 onto a water tank 52 or onto the rim 68 of another cabinet assembly 51 as depicted in FIG. 5.

Figure 4:
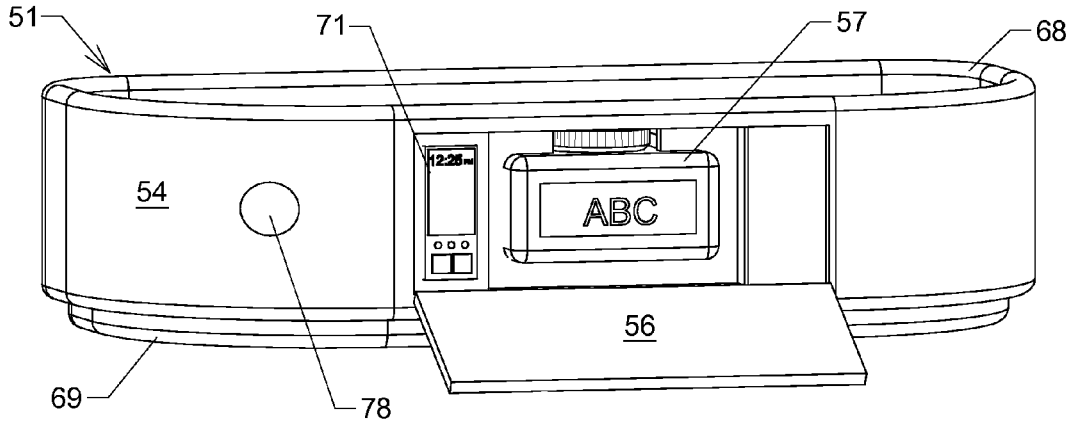
FIG. 4 is a front perspective view of a single-cartridge version of the modular liquid dispenser with its cartridge access cover open to reveal a single docked cartridge and an electronic control module.

FIG. 4 is a top front perspective view of a single-cartridge version of the modular liquid dispenser cabinet assembly 51 with its cartridge access cover 56 open. A refillable cartridge 57 can be seen docked into the cabinet 54. A programmable electronic control module 71 allows the assembly 51 to be programmed in a variety of ways.

FIG. 5 is a top front perspective view of two single-cartridge versions of the modular liquid dispenser cabinet assemblies 51 stacked together. This allows for two different types of solutions to be dispensed into the water tank 52. Each modular liquid dispenser cabinet assembly 51 has a rim 68 and a mounting guide 69 that allows them to be stacked onto each other and onto the water tank 52.

Figure 6:
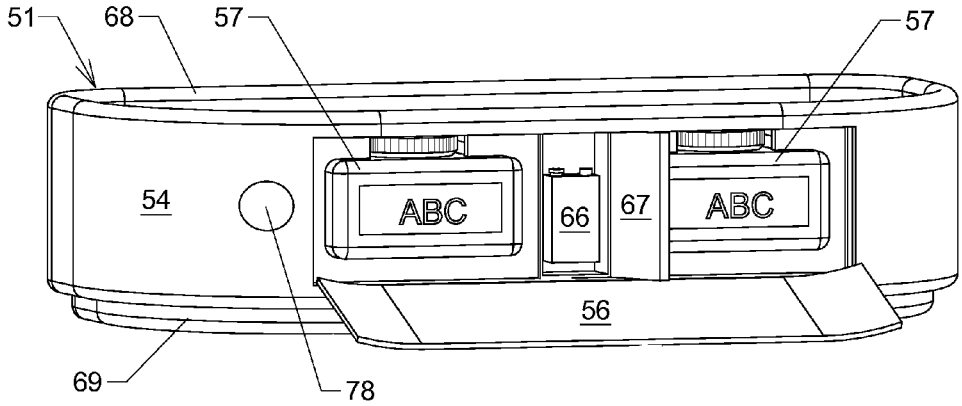
FIG. 6 is a front view of a dual-cartridge version of the modular liquid dispenser illustrating the two docked cartridges and shows a battery compartment cover open to reveal a battery that supplies power for the system.

FIG. 6 is a front view of a dual-cartridge version of the modular liquid dispenser cabinet assembly 51 illustrating two refillable docked cartridges 57 and also shows a battery compartment cover 67 open to reveal a battery 66 that supplies power for the system.

Figure 7:
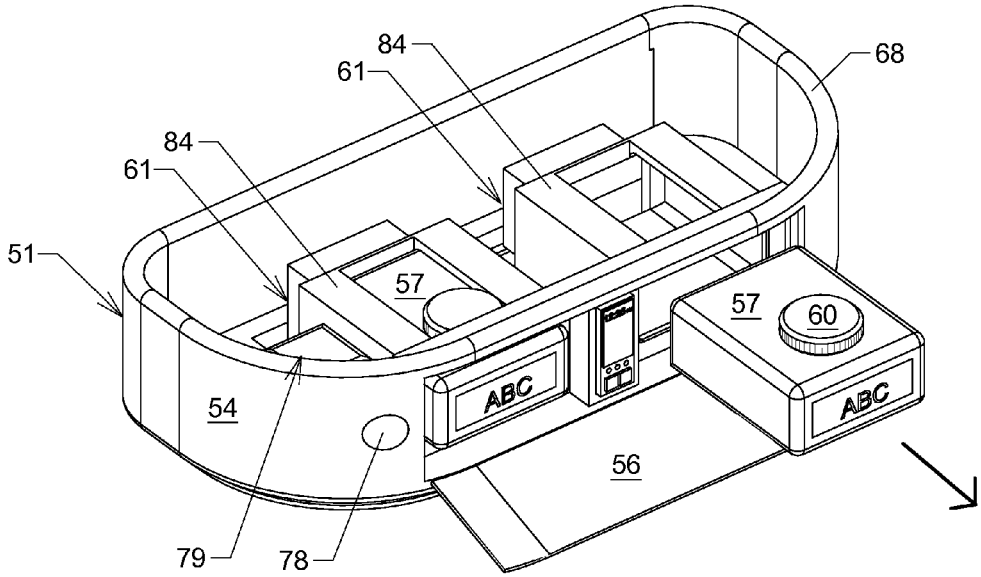
FIG. 7 is a top front perspective view of a dual-cartridge version of the modular liquid dispenser with the cabinet top off to reveal the components mounted inside and is also shown with one of the cartridges pulled out to illustrate its removability.

FIG. 7 is a top front perspective view of a dual-cartridge version of the modular liquid dispenser cabinet assembly 51 with the cabinet top off to reveal the components mounted inside and is also shown with one of the refillable cartridges 57 pulled out to illustrate its removability. A cartridge alignment and support guide 84 keeps the cartridge 57 aligned and supported within the cabinet 54 while the cartridge 57 is inserted so that can then properly mate with the liquid pump assembly 61 that is mounted at the back of the guide 84.

Figure 8:
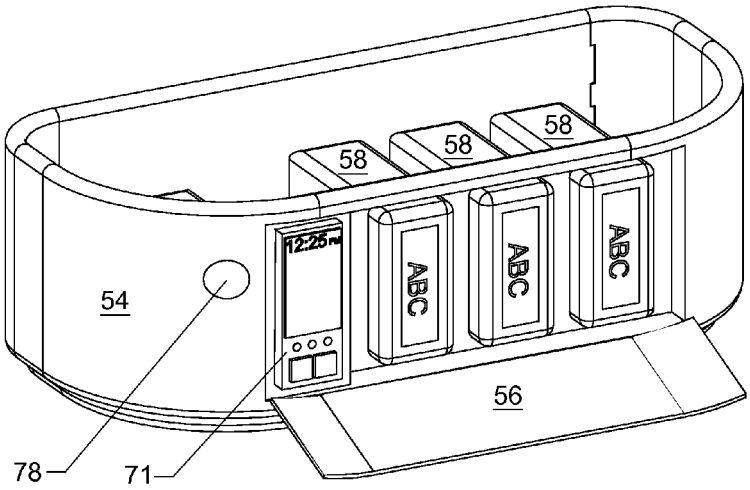
FIG. 8 is a front view of a three-cartridge version of the modular liquid dispenser illustrating the three docked cartridges and an electronic control module that is used to program each dispenser independently.

FIG. 8 is a front view of a three-cartridge version of the modular liquid dispenser cabinet assembly 51 illustrating three docked disposable cartridges 58 and a single electronic control module 71 that is used to program each liquid dispenser independently.

Figure 9:
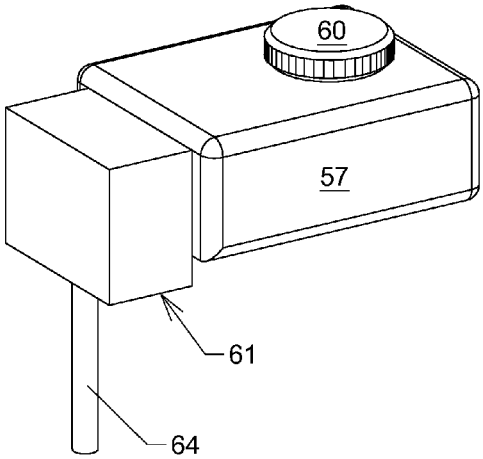
FIG. 9 is a top rear perspective view of a liquid cartridge and liquid pump assembly to show how they would normally be mated together inside the cabinet.

FIG. 9 is a top rear perspective view of a liquid cartridge 57 and liquid pump assembly 61 to show how they would normally be mated together inside the cabinet 54.

Figure 10:
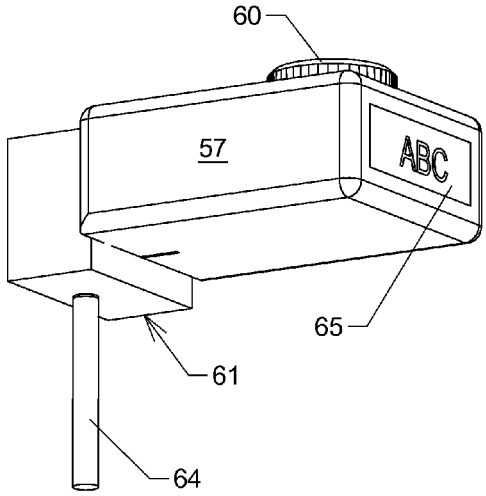
FIG. 10 is a lower front perspective view of a liquid cartridge and liquid pump assembly to show how they would normally be mated together inside the cabinet.

FIG. 10 is a lower front perspective view of a liquid cartridge 57 and liquid pump assembly 61 to show how they would normally be mated together inside the cabinet 54. A label 65 can be affixed to the cartridge 57 to identify its contents.

Figure 11:
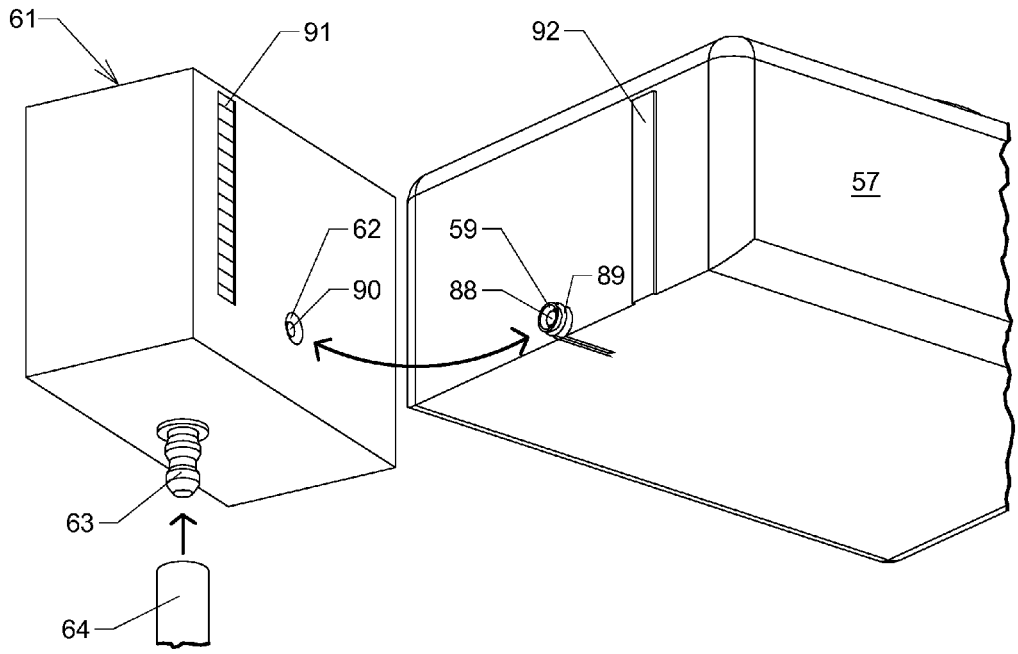
FIG. 11 is a lower front perspective view of a liquid cartridge and liquid pump assembly with the liquid pump assembly slightly cocked from the normal alignment with the cartridge to illustrate the orientation of the mating orifices that communicate the liquid from the cartridge to the pump assembly. This view also shows the liquid level sensor on the pump assembly and its mating window pane on the cartridge.

FIG. 11 is a rear lower perspective view of the liquid pump assembly 61 as slightly cocked from its normal alignment with the liquid cartridge 57 to illustrate the mating of the cartridge drain tube 59 with the liquid pump inlet fitting 62 that conveys the liquid from the cartridge 57 into the pump assembly 61. Once the cartridge 57 is completely inserted into the cabinet 54, its drain tube 59 becomes mated with liquid pump inlet fitting 62. An O-ring style seal 89 is used around the outside circumference of the drain tube 59 so that it can seal with the inlet fitting 62. A stationary valve actuator pin 90 inside the pump inlet fitting 62 pushes against the liquid drain valve 88 inside the cartridge drain tube 59, causing it to open and allows the liquid inside cartridge 57 to flow into the pump inlet fitting 62. Once the pump assembly 61 is activated, liquid is drawn out of the cartridge 57 and is discharged through a liquid pump discharge fitting 63 where a flexible liquid discharge tube 64 then directs the liquid down to the water 93 inside the water tank 52.

FIG. 11 also shows an electronic liquid level sensor 91 on the pump assembly 61 and a liquid level window pane 92 on the cartridge 57. The pane 92 normally rests within very close proximity to the level sensor 91. The window pane 92 portion of the cartridge 57 is made of a transparent material so that the sensor 91 can detect the level of the fluid inside the cartridge 57. The level sensor 91 communicates with the control module 71 so that the fluid level can be known and displayed. The control module 71 could flash a lamp or provide a periodic audible beep to signal a low fluid level condition.

Figure 12:
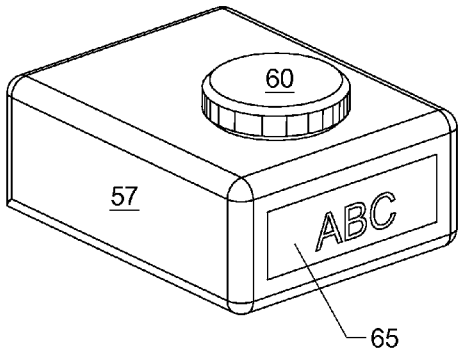
FIG. 12 is a front perspective view of a refillable version of the liquid cartridge that utilizes a ventilated refill cap.

FIG. 12 is a front perspective view of a refillable liquid cartridge 57 shown with its refill cap 60. The refill cap 60 is ventilated, which allows a one-way flow of air into the cartridge 57 as its solution is consumed. The refillable cartridge 57 can be removed at any time, where a spring loaded drain valve 88 located inside its drain tube 59 closes whenever it is pulled away from the pump assembly 61. The refill cap 60 can be removed and more solution added, as depicted in FIG. 11. A label 65 is shown affixed to the front of the cartridge 57 to identify its contents.

Figure 13:
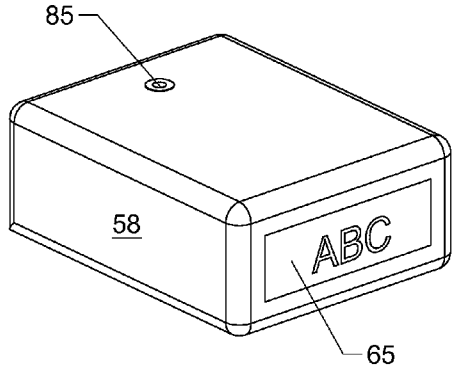
FIG. 13 is a front perspective view of the disposable version of the liquid cartridge with a pressure relief valve located on its top side.

FIG. 13 is a front perspective view of a disposable liquid cartridge 58. This disposable cartridge 58 has no refill cap 60 since it is meant to be disposable. However, a refillable cartridge 57 could also be disposable. FIG. 13 also shows a pressure relief valve 85 which allows a one-way flow of air into the cartridge 58 as its solution is consumed. The disposable cartridge 58 can be removed at any time, where a spring loaded drain valve 88 located inside its drain tube 59 closes whenever it is pulled away from the pump assembly 61, as depicted in FIG. 11. A label 65 is shown affixed to the front of the cartridge 58 to identify its contents.

As shown in FIG. 7, the cabinet assembly 51 is designed to accept a refillable cartridge 57, which allows insertion room for its cap 60. But the cabinet assembly 51 can also accommodate the disposable cartridge 58 version as well, since the cap-less disposable cartridge 58 will still fit into the same cartridge slot.

Figure 14:
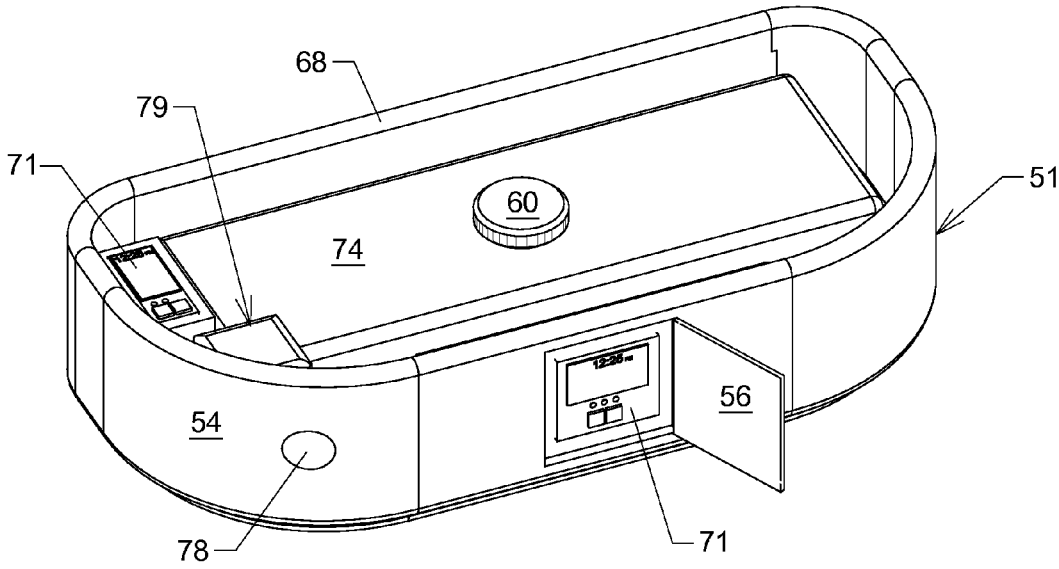
FIG. 14 is front perspective view of the modular liquid dispenser where the liquid is stored in a larger, fixed tank rather than a smaller, removable cartridge.

FIG. 14 is front perspective view of an embodiment of the present invention where the modular liquid dispenser cabinet assembly 51 uses a larger, fixed tank 74 rather than a smaller, removable cartridge 57. This larger tank 74 can be permanently fixed inside the cabinet 54 or could be made to be removable like the cartridge 57 version. The advantage of this embodiment is that a very large tank 74 can hold a lot of solution 80, so that maintenance intervals would be extended. The disadvantage would be that the tank lid 53 would have to be removed to service the unit.

Figure 15:
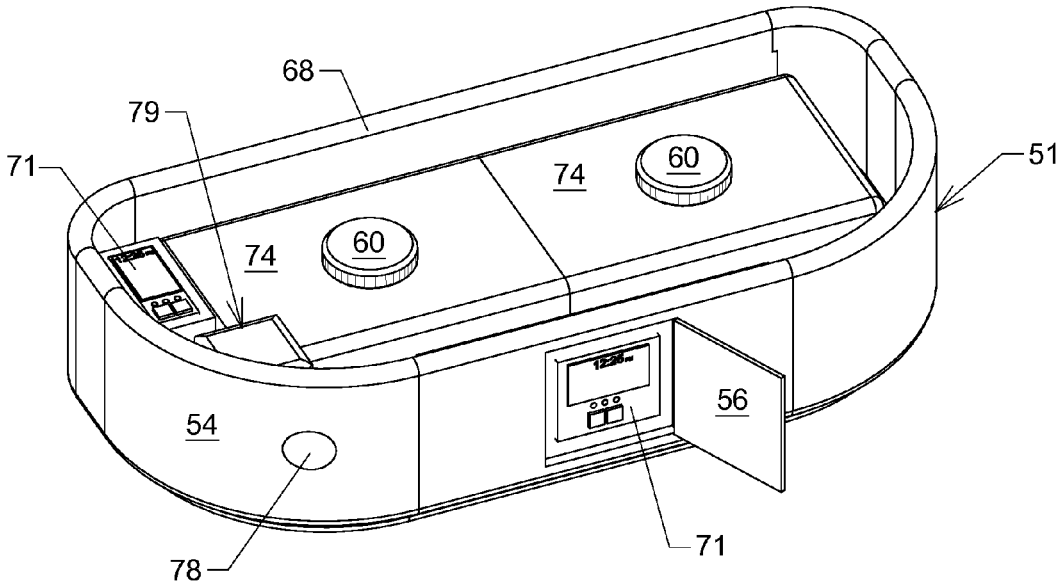
FIG. 15 is front perspective view of the modular liquid dispenser where the liquid is stored in two larger, fixed tanks rather than smaller, removable cartridges.

FIG. 15 is front perspective view of an embodiment of the present invention where the modular liquid dispenser cabinet assembly 51 uses two larger fixed tanks 74 rather than the smaller, removable cartridges 57. These larger tanks 74 can be permanently fixed inside the cabinet 54 or could be made to be removable like the cartridge version.

Figure 16:
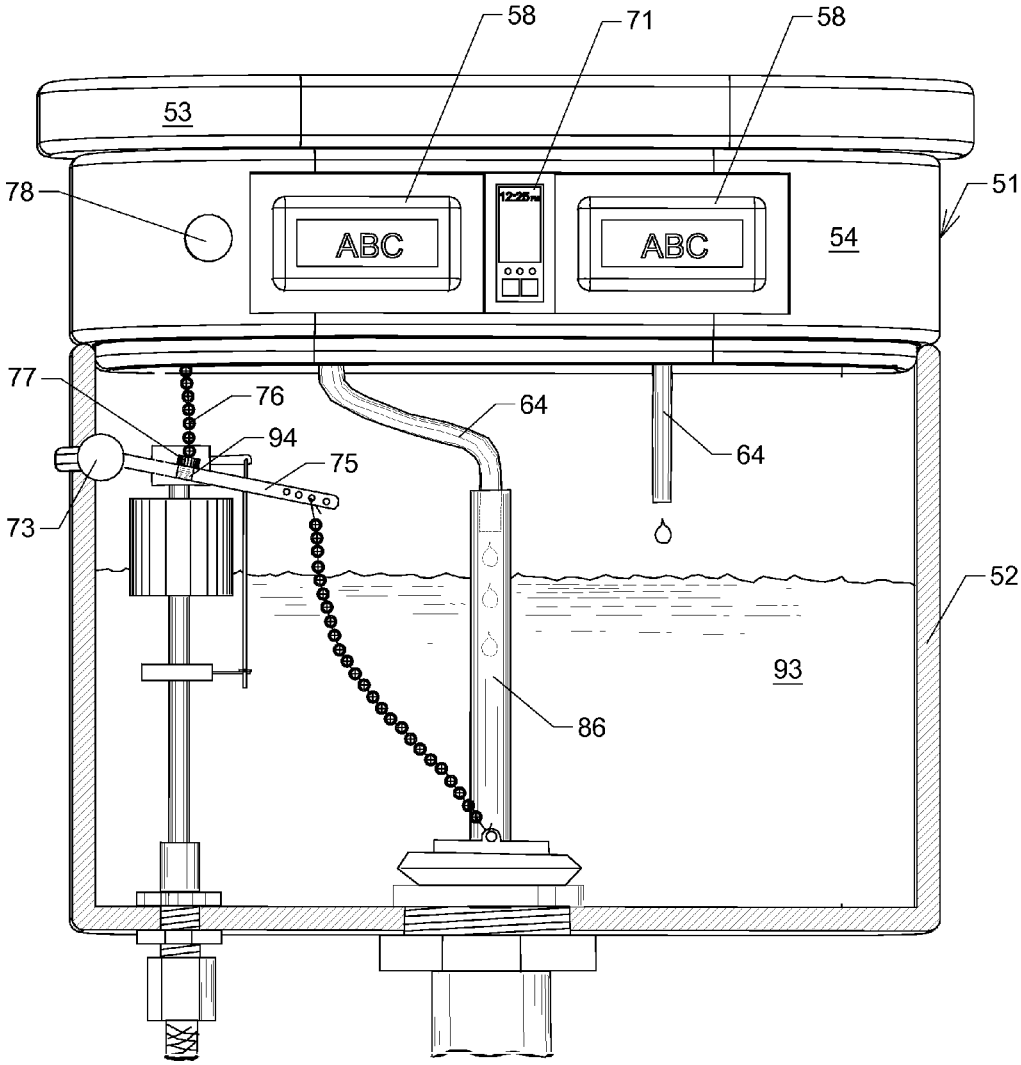
FIG. 16 is front view of the modular liquid dispenser as mounted on a toilet tank, with a cross section view of the tank to reveal how the discharge tube of the dispenser can be inserted inside the overflow pipe and also shows the automatic flush control linkage cable connection to the flush actuator lever.

FIG. 16 is front view of the present invention where the modular liquid dispenser cabinet assembly 51 is mounted on a toilet water tank 52, with a cross section view of the water tank 52. A flexible discharge tube 64 allows a user to place the tube 64 inside the toilet tank overflow pipe 86, or can be used to route the flow of solution 80 around obstacles inside the tank 52. FIG. 16 depicts the discharge tube 64 of the left liquid pump assembly 61 as inserted into the overflow pipe 86. This allows an application of solution 80 to be dispensed full strength, directly into the toilet bowl 55. This may be desired if a user wants to administer a few drops of a deodorant solution, or wants to inject a large, full strength dose of a mineral scale dissolving solution directly to the bowl 55. The second discharge tube 64 on the right side is shown positioned to discharge its solution 80 into the water 93 inside the water tank 52. A longer discharge tube 64 would allow it to reach the tank 52 if the cabinet 54 is stacked onto other cabinets 54 as shown in FIG. 5. Liquid discharge tube passageway slots 70 in each cabinet would allow the discharge tubes 64 to extend down through each cabinet to finally reach the tank 52.

FIG. 16 also shows the automatic flush lever control linkage 76 connection to the flush actuator lever 75 with a flush actuator lever linkage attachment magnet 77. In the event that the actuator lever is plastic or other non-magnetic material, a small metal clip can be clipped onto the lever 75 so that the lever attachment magnet 77 can still detachably couple with the lever 75. This technique to engage the lever 75 allows for a quick and tool-less connection to attach the linkage 76 to the lever 75. It would also allow the cabinet assembly 51 to be quickly removed, as would be desired if the toilet tank components need fast service, as in the case of a stuck flush valve.

Figure 17:
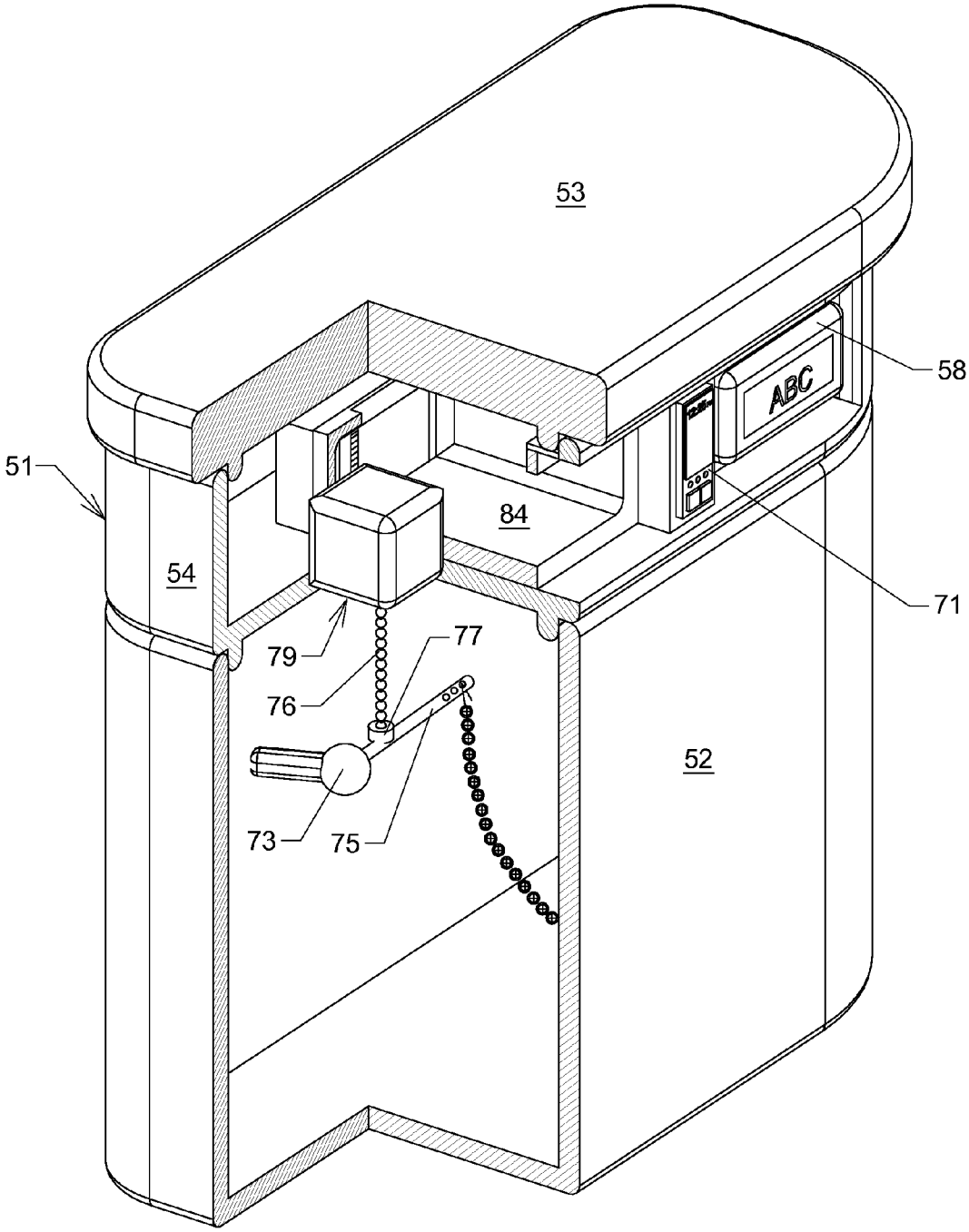
FIG. 17 is front perspective view of the modular liquid dispenser as mounted on a toilet tank, with a cross section view of the tank to reveal the details of the flush sensor and automatic flush control assembly.

FIG. 17 is front perspective view of the modular liquid dispenser cabinet assembly 51 as mounted on a toilet tank 52, with a cross section view of the water tank 52 to reveal the details of the automatic flush control system. The toilet flush actuator assembly 79 is positioned over the toilet flush actuator lever 75. A linkage 76 with a magnet 77 connects the flush assembly 79 to the lever 75. An automatic flush cycle starts when the electronic control module 71 detects that the toilet is in use, by monitoring the proximity detector 78. The module 71 then waits until a time interval after the proximity detector 78 detects that a person has left the toilet. The module 71 then applies power to the flush actuator assembly 79 that then applies an upward force on the flush actuator lever linkage 76. This in turn pulls up the attached flush actuator lever linkage 76 and its attachment magnet 77 which is magnetically coupled to the flush actuator lever 75, thereby pulling up the lever 75 to perform a toilet flush. If the person actually flushes the toilet, then the automatic flush cycle would be canceled. The module 71 can also be programmed to performed automatic timed flushes. For example, the module 71 can be programmed to flush the toilet at least once a week, if it detects no flush had taken place in that time interval.

The toilet flush assembly 79 is a dual purpose device. It contains a device that can mechanically lift the flush actuator lever 75 in order to flush the toilet and also contains a device that is able to sense that a toilet flush has occurred. The mechanical lifting mechanism is used to automatically flush the toilet by pulling on the linkage 76 that is connected to the flush actuator lever 75, thereby performing a toilet flush. A flush sensing device is utilized by sensing the movement of the linkage 76 which is designed to retract into the flush assembly 79 if the flush actuator lever 75 is moved. This provides the control module 71 with a signal so that it can trigger a release of water treatment solution.

Figure 18:
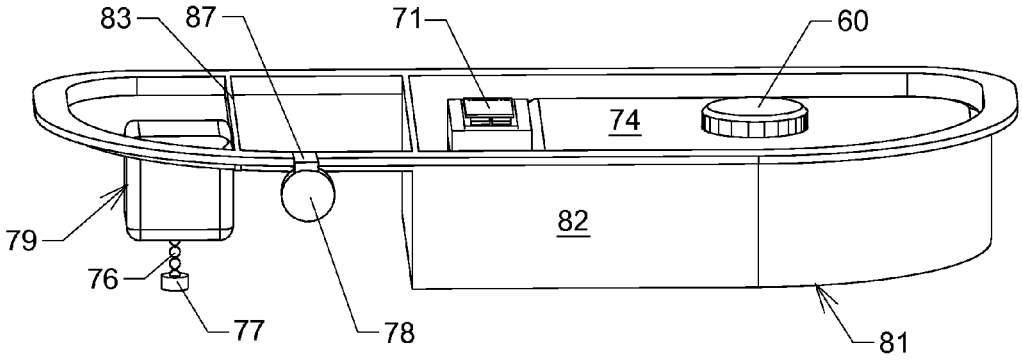
FIG. 18 is front perspective of a low-profile embodiment of the invention that includes a large tank reservoir.

FIG. 18 is front perspective of a low-profile embodiment of the present invention that includes a large tank 74 reservoir. A low-rise chassis 82 is able to hide the whole dispenser assembly 81 inside the water tank 52. A flush sensor and flush actuator assembly 79 is mounted on an adjustable rail 83 to allow the assembly 79 to be moved for an optimal position. An optional proximity detector 78 protrudes from the chassis 82 so as to hang down over the edge of the water tank 52 so that it can be able to detect the toilet's occupancy for automatic flushing. It utilizes an adjustable clip 87 so that it can be mounted so that it is free from interference with the opening and closing of the toilet seat and seat lid. This detector 78 would be the only component of this embodiment that would be visible to the user.

Figure 19:
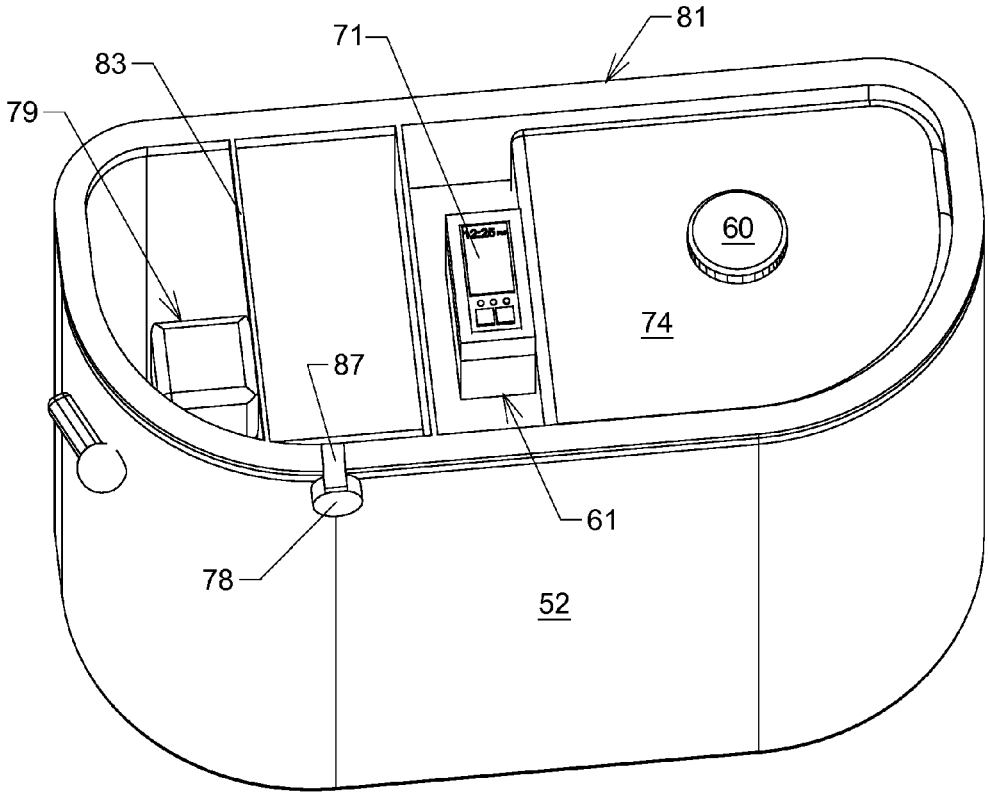
FIG. 19 is front perspective of a low-profile embodiment of the invention that includes a large tank reservoir and shown as mounted inside a standard toilet water tank to demonstrate the low-profile nature of the chassis.

FIG. 19 is front perspective of a low-profile embodiment of the present invention that includes a large tank 74 reservoir and is shown as mounted inside a standard toilet water tank 52 to demonstrate how the low-profile dispenser assembly 81 resides inside the water tank 52, which would be completely hidden from view once the tank lid 53 is installed.

The advantage of this embodiment is that the dispenser assembly 81 is hidden, so that it has no impact on the aesthetics of the toilet and bathroom. Also, a larger tank 74 would require longer service time intervals. The disadvantage would be that the tank lid 53 would have to be removed and the tanks 74 would have to be refilled, which could be messy.

Figure 20:
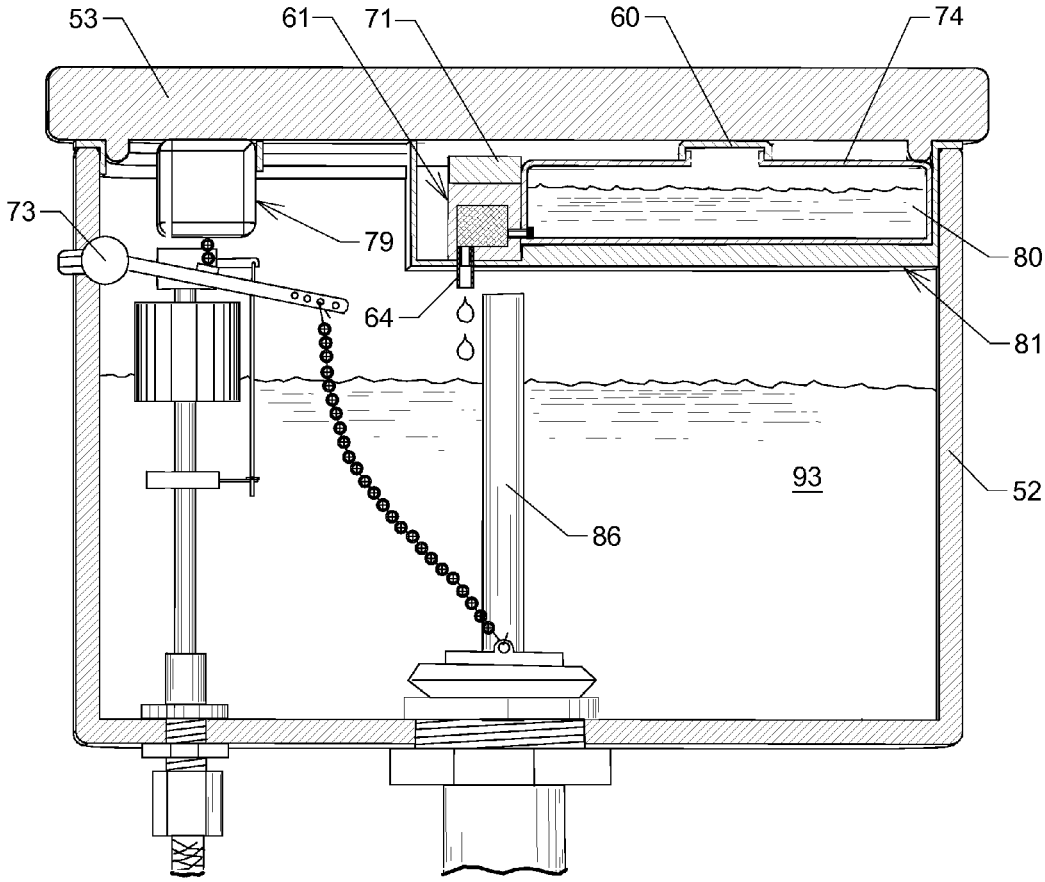
FIG. 20 is front sectional view of a low-profile embodiment of the invention that includes a large tank reservoir and shown as mounted inside a standard toilet water tank to demonstrate the low-profile, hidden nature of the chassis.

FIG. 20 is front sectional view of a low-profile embodiment of the present invention that includes a large tank 74 reservoir and is shown as mounted inside a standard toilet water tank 52 to demonstrate how the low-profile dispenser assembly 81 resides inside the water tank 52, which would be completely hidden from view once the tank lid 53 is installed.

Figure 21:
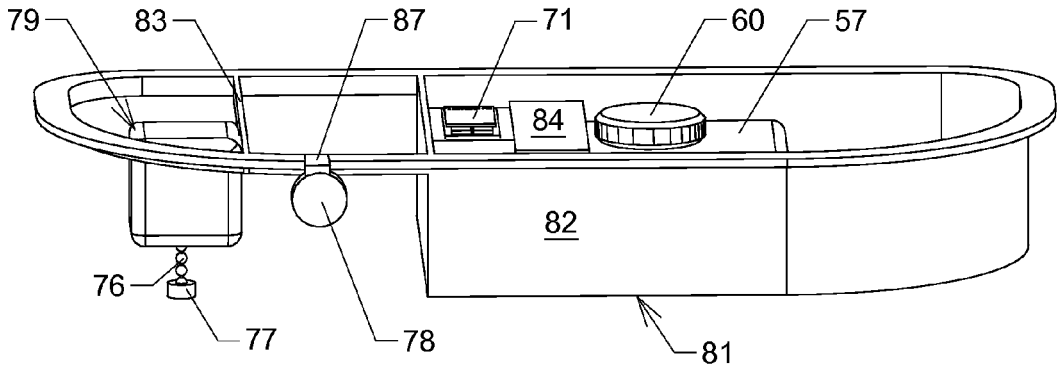
FIG. 21 is front perspective of a low-profile embodiment of the invention that uses a replaceable liquid cartridge.
Figure 22:
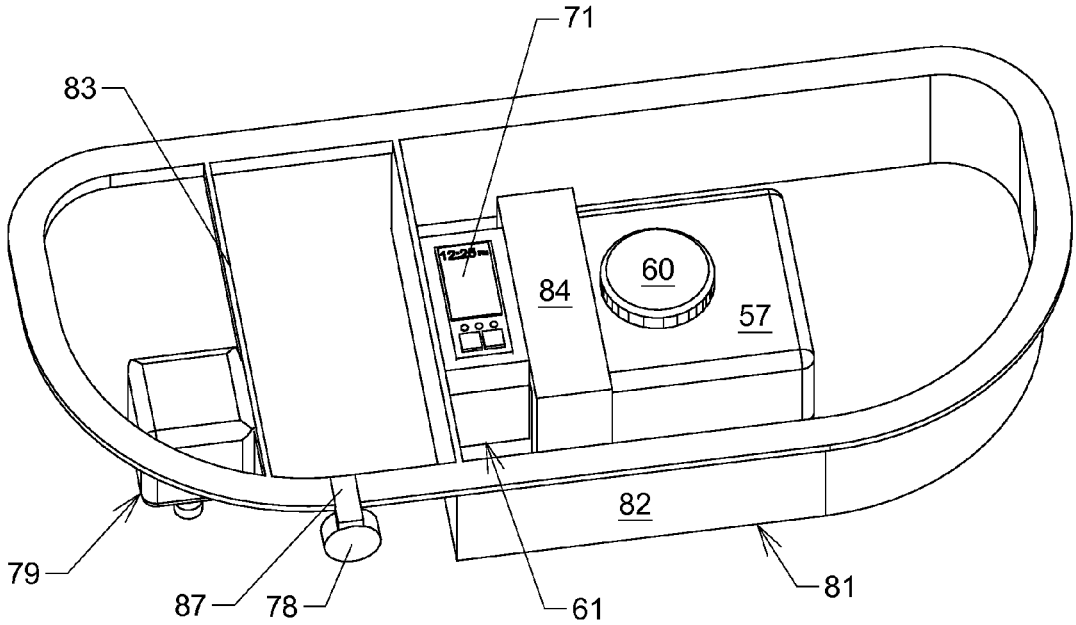
FIG. 22 is top front perspective of a low-profile embodiment of the invention that uses a replaceable liquid cartridge.

FIG. 21 and FIG. 22 are front perspectives of a low-profile embodiment of the present invention that uses a replaceable liquid cartridge 57. A low-rise chassis 82 is able to hide the whole dispenser assembly 81 inside the water tank 52. A flush sensor and flush actuator assembly 79 is mounted on an adjustable rail 83 to allow the assembly 79 to be moved for an optimal position. An optional proximity detector 78 protrudes from the chassis 82 so as to hang down over the edge of the water tank 52 so that it can be able to detect the toilet's occupancy for automatic flushing. It utilizes an adjustable clip 87 so that it can be mounted so that it is free from interference with the opening and closing of the toilet seat and seat lid. This detector 78 would be the only component of this embodiment that would be visible to the user. The advantage of this embodiment is that the assembly 81 is hidden, so that the assembly 81 has no impact on the aesthetics of the toilet and bathroom. This liquid cartridge 57 embodiment also allows the ability to use convenient disposable cartridges 58, saving the trouble of potentially messy refills. The disadvantage would be that the tank lid 53 would have to be removed to service the unit.

What is claimed is:

1. A liquid dispensing system to dispense at least one type of liquid into a toilet water system or a bidet apparatus, comprising:

a) at least one electrically operated liquid pump, b) at least one liquid inlet orifice connected to said pump, c) at least one cartridge removably coupled to said inlet orifice, comprising:

(1) a drain valve that can open and close to release liquid from said cartridge, (2) a means to keep said drain valve closed when said cartridge is removed from said inlet orifice, d) at least one valve actuator, whereby said valve actuator can open said drain valve when said cartridge is coupled to said inlet orifice, and whereby liquid can be released from said cartridge to said pump through said drain valve and said inlet orifice, e) a means for sensing a flushed toilet, f) an electronic control module, whereby said control module, using said means for sensing a flushed toilet, actives said liquid pump to pump a predetermined amount of liquid from said cartridge to said toilet water system or said bidet apparatus.

2. The liquid dispensing system of claim 1, further including a cabinet having a front side and bottom side, and defining an interior space, comprising:

a) a mounting guide on said cabinet bottom side whereby said cabinet can mount onto a toilet water tank;

b) at least one compartment in said cabinet interior space for the mounting of components;

c) an aperture in said cabinet front side to allow access to said cabinet interior space for the purpose of inserting and removing said cartridges.

3. The liquid dispensing system of claim 1, further including a chassis that uses a mounting rim or hanging strap whereby said liquid dispensing system can protrude down inside of a toilet water tank.

4. The liquid dispensing system of claim 1 wherein a means to keep said drain valve normally closed while said cartridge is removed from said inlet orifice is a spring.

5. The liquid dispensing system of claim 1 wherein a means for sensing a flushed toilet is a movement sensor that is attached to a toilet flush actuator.

6. The liquid dispensing system of claim 1, further including a means to automatically flush said toilet.

7. The liquid dispensing system of claim 6, wherein a means to automatically flush said toilet comprising a proximity detector and a solenoid connected to a toilet flush actuator, whereby said control module can use said proximity detector to determine when to flush and then use said solenoid to lift said flush actuator to perform an automatic flush.

8. The liquid dispensing system of claim 1 wherein said cartridge is made of a transparent or semitransparent material.

9. The liquid dispensing system of claim 1, further including a removable cap on said cartridge to allow said cartridge to be refillable and reusable.

10. The liquid dispensing system of claim 1, further including an electronic fluid level detector.

11. The liquid dispensing system of claim 1, further including a liquid outlet orifice connected to said liquid pump that can direct liquid from said pump to any one or combination of a toilet water tank, a toilet overfill tube or a bidet device.

12. A liquid dispensing system to dispense at least one type of liquid into a toilet water system or a bidet apparatus, comprising:

a) at least one electrically operated liquid pump, b) at least one liquid inlet orifice connected to said pump, c) at least one tank to contain liquid, d) a means for sensing a flushed toilet, e) an electronic control module, whereby said control module, using said means for sensing a flushed toilet, actives said liquid pump to pump a predetermined amount of liquid from said cartridge to said toilet water system or said bidet apparatus.

13. The liquid dispensing system of claim 12, further including a cabinet having a bottom side, and defining an interior space, comprising:

a) a mounting guide on said cabinet bottom side whereby said cabinet can mount onto a toilet water tank, b) at least one compartment in said cabinet interior space for the mounting of components.

14. The liquid dispensing system of claim 12, further including a chassis that uses a mounting rim or hanging strap whereby said liquid dispensing system can protrude down inside of a toilet water tank.

15. The liquid dispensing system of claim 12 wherein a means for sensing a flushed toilet is a movement sensor that is attached to a toilet flush actuator.

16. The liquid dispensing system of claim 12, further including a means to automatically flush said toilet.

17. The liquid dispensing system of claim 16, wherein a means to automatically flush said toilet, comprising a proximity detector and a solenoid connected to a toilet flush actuator, whereby said control module can use said proximity detector to determine when to flush and then use said solenoid to lift said flush actuator to perform an automatic flush.

18. The liquid dispensing system of claim 12 wherein said tank is made of a transparent or semitransparent material.

19. The liquid dispensing system of claim 12, further including an electronic fluid level detector.

20. The liquid dispensing system of claim 12, further including a liquid outlet orifice connected to said liquid pump that can direct liquid from said pump to any one or combination of a toilet water tank, a toilet overfill tube or a bidet device.

* * * * *